United States Patent [19]

Brown

[11] 4,418,344

[45] Nov. 29, 1983

[54] VIDEO DISPLAY TERMINAL

[75] Inventor: Robert J. Brown, Hammonton, N.J.

[73] Assignee: Datamedia Corporation, Pennsauken, N.J.

[21] Appl. No.: 329,551

[22] Filed: Dec. 10, 1981

[51] Int. Cl.[3] ..... G09G 1/16

[52] U.S. Cl. ..... 340/726; 340/750; 340/792

[58] Field of Search ..... 340/726, 723, 724, 750, 340/791, 799

[56] References Cited

U.S. PATENT DOCUMENTS

| | | | |
|---|---|---|---|
| 3,787,833 | 1/1974 | Rogers | 340/726 |
| 4,249,172 | 2/1981 | Watkins et al. | 340/726 |
| 4,284,988 | 8/1981 | Seitz et al. | 340/792 |
| 4,309,700 | 1/1982 | Kraemer | 340/726 |
| 4,375,638 | 3/1983 | O'Keefe et al. | 340/726 |

*Primary Examiner*—Gerald L. Brigance
*Attorney, Agent, or Firm*—Beveridge, De Grandi & Kline

[57] ABSTRACT

A video display terminal permitting substantially continuous scrolling of the display. Each character row of the display is stored in the display memory in a memory segment which also stores one or more parameter bytes associated with the character row. A first parameter byte portion indicates the number of the scan line on which the display of that character row is to commence during the current frame. A second parameter byte portion indicates the number of scan lines of that character row which are to be displayed during that frame. A memory address within the parameter bytes indicates the address of the memory segment storing the next character row to be displayed. This memory address is applied directly to the DMA controller. As a consequence, scrolling only requires a CPU interrupt during each vertical retrace interval to update the parameter byte information to increment and/or decrement the first scan line number and the number of scan lines and to link the memory segments as required when a row is scrolled completely off the display and when scrolling of a new row onto the display is initiated.

8 Claims, 5 Drawing Figures

VIDEO DISPLAY TERMINAL

BACKGROUND OF THE INVENTION

The present invention pertains to a video display terminal. More particularly, the present invention pertains to a self-synchronous video display terminal having a self-linked direct memory access, permitting substantially continuous scrolling of the display, including split screen scrolling in which a portion, but not all, of the display is scrolled.

Video display terminals are commonly used to display information of interest to numerous people. Typically such terminals can display at one time 24 or more character rows of text material, with each character row including numerous characters, for example up to 132 characters. Many terminals also can provide graphical displays. Most such terminals generate their displays in a dot matrix pattern utilizing a television raster scan technique. In such systems each character row is formed of several scan lines, and so one scan line of every character in a row is generated on the display device, followed by the next scan line of every character of that row, etc. Within each scan line each character portion is formed as a pattern of dots, with the dots being formed by blanking or unblanking of the cathode ray tube beam. The dots are generated at a dot rate determined in accordance with the scan line interval, the number of characters per row, and the number of dots per character. Once the beam has progressed through its raster scan pattern to the bottom of the display screen, it returns to the top to commence scanning of a new frame. A vertical synchronization signal occurs with each frame, enables synchronization of the entire system, and initiates a vertical retrace interval during which control functions can take place.

Often there is more material which it is desired to display than can be displayed at one time. This is particularly true when displaying text or alphanumerical material. In such situations, one "page" of text material can be displayed in a continuous display for an interval of time sufficient to permit the user to read or otherwise utilize all of that material, following which that page of material can be replaced by a new page. Such a technique is not altogether satisfactory, however, because different users of the terminal will read or otherwise utilize the material at different rates, and so either each page of material remains available on the display for a time appropriate for someone who reads it comparatively rapidly, with the result that a slower reader does not have sufficient time to read it all, or each page remains on the display for a sufficient time for the slower reader to utilize it, with the result that the faster reader must wait after he has read to the bottom of each page of the display. Further, in many applications it is often desired to display a large amount of text material and the user may wish to go back and forth between different locations in the material. If the material is on separate pages, it is inconvenient to search for a particular portion of the material.

Techniques have been developed for causing the text material in a display to scroll; i.e., to move upwardly or downwardly a row at a time. By way of example, in an upward scroll the top line of characters in the display is removed, the remaining lines are moved up one line, and a new line of characters is inserted at the bottom of the display. Most of the existing terminals permitting such scrolling, however, utilize a "jump scroll" technique in which at set intervals, such as one second intervals, the top line of the display is erased, the remaining lines moved upward, and a new line inserted at the bottom. U.S. Pat. No. 3,921,148, the disclosure of which is incorporated herein by reference, discloses such a terminal, with the scrolling technique particularly being set out at column 15, line 45 through column 17, line 55 of that patent in conjunction with FIGS. 8, 9, and 10 of the patent. This technique is undesirable since the displayed material periodically jumps upward and it is difficult for the reader to follow the display, and so difficult for him to read the material. Additionally, the majority of such jump scroll techniques require that all of the characters in the display be stored in contiguous storage locations within the display memory. While this is not a problem when the display is first generated, if it is desired to insert a new line into the middle of the display, then all of the characters stored at later or higher addressed locations must be moved to make room for the new line of characters. Further, in such systems the entire display must be scrolled; it is not possible to provide a split screen display in which a portion of the display is scrolled, with the remainder staying fixed.

One technique for providing substantially continuous scrolling of the display, including if desired a split screen display, involves storing a coded representation of the data characters of each character row of the display in encoded data words, each having as many bytes as there are characters in the character row as well as having a control byte indicating the number of the first scan line of that character row which is to be displayed during the current frame and indicating any attributes for that character row such as enlarged character size, blinking of the character row, reversed background, or different intensity of the display for that character row, and at the start of each character row of the display having the central processing unit of the display terminal apply further control signals to the direct memory access controller indicating the number of scan lines of the character row which are to be displayed during that frame and the memory address of the first byte within the data word for the next character row to be displayed. By incrementing the number of the first scan line to be displayed and decrementing the number of scan lines to be displayed, a character row can be scrolled off the display. Likewise, by incrementing the number of scan lines to be displayed, a new character row can be scrolled onto the display. This approach, however, necessitates interrupting the central processing unit at the end of each character row in order to obtain these further control signals. During the first frame of a continuous scroll, when a new row of characters is first being inserted and an old row is being removed, only one scan line of that new row is displayed and all but one scan line of the old character row are displayed. During each of the following frames another scan line is added to the new character row and another scan line is removed from the old. In the last frame of the scroll, then, all but one scan line of the new row are presented and only one scan line of the old. As a consequence, during the first and the last frames of the scroll, there must be a central processing unit interrupt at the beginning of each of two consecutive scan lines. During each interrupt, the central processing unit must transfer to the direct memory access controller the aforementioned further control signals. When the next interrupt is to occur after only one scan line, there is not sufficient time for the central processing unit to transfer the further control signals. In existing video display terminals permitting substantially continuous scrolling and split screen scrolling, this problem is overcome by utilization of an auxiliary two byte storage port to which the central processing unit applies control information as to the scroll in advance of the scroll boundaries and to which the direct memory access controller is steered at the boundaries of the scroll to obtain that information. Nevertheless, a great deal of processing time is required by this technique, as well as a considerable amount of hardware.

SUMMARY OF THE INVENTION

The present invention is a video display terminal permitting substantially continuous scrolling of the display, including split screen scrolling, while overcoming these problems of existing terminals. In accordance with the present invention, all of the control information for a character row is contained in one or more parameter bytes which form a part of the data words stored in the display memory for that character row and the preceding character row. Thus, the data word for a particular character row includes a control byte indicating the attributes for that row and the number of the first scan line of that row which is to be displayed during the current frame, a plurality of character bytes equal in number to the number of character spaces in the character row and each containing an encoded representation of the character to be displayed in the associated character space, and one or more linking bytes containing the number of scan lines of that row which are to be displayed and the address within the display memory of the data word for the next character row. The number of scan lines to be displayed is applied to a counter which, after that number of scan lines, indicates the end of that character row. The memory address of the data word for the next character row is applied directly to the direct memory access controller to cause it to access that memory location when the next row of characters is to be displayed. Thus, the scrolling function requires the central processing unit to be interrupted only once per frame, for the purpose of updating these parameter bytes.

Further, by this technique only the characters of a given row need to be stored in contiguous locations within the display memory. Consequently, if it is desired to insert a new row of characters into the middle of a display, the data word for that character row can be stored at the end of the existing data words within the display memory, and the linking byte of the data word for the character row to be displayed just before the point at which the new row is to be inserted is provided with the memory address of this newly stored data word, while the linking byte of the newly stored data word contains the memory address of the data word for the following character row.

BRIEF DESCRIPTION OF THE DRAWINGS

These and other aspects and advantages of the present invention are more apparent from the following detailed description and claims, particularly when considered in conjunction with the accompanying drawings. In the drawings:

DETAILED DESCRIPTION OF A PREFERRED EMBODIMENT OF THE INVENTION

Figure 1:
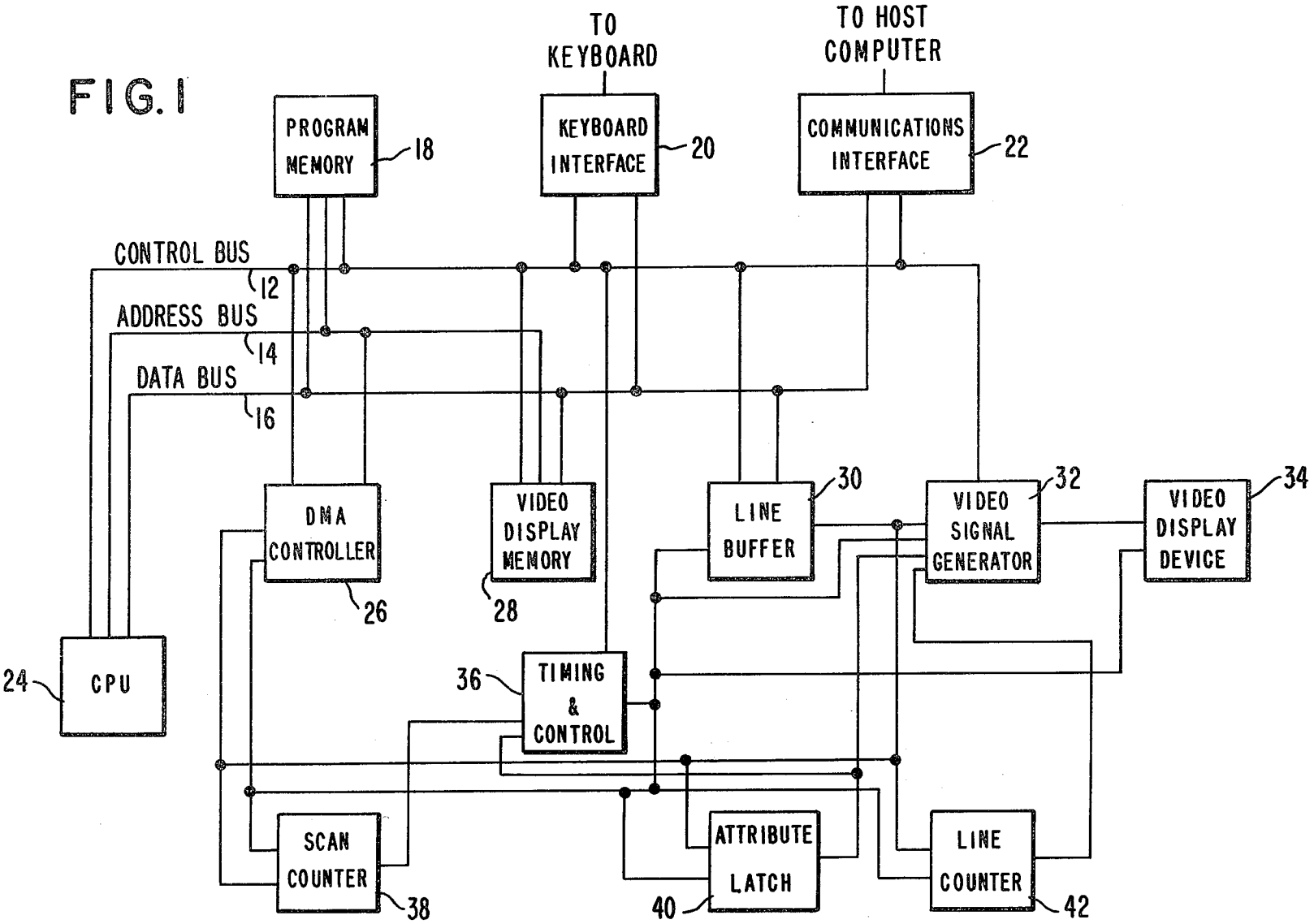
FIG. 1 is a block diagram of a preferred embodiment of a video display terminal in accordance with the present invention.

FIG. 1 depicts a preferred embodiment of a video display terminal in accordance with the present invention. Control bus 12, address bus 14, and data bus 16 permit interconnection of various components of the terminal, including program memory 18, keyboard interface 20, which in turn is coupled to a keyboard, communications interface 22, which in turn is coupled to a host computer, central processing unit (CPU) 24, direct memory access (DMA) controller 26, video display memory 28, line buffer 30, video signal generator 32, and timing and control circuit 36. In addition, the terminal includes a video display device of a television raster scan type 34, scan counter 38, attribute latch 40, and line counter 42, some of which may also be coupled to one or more of the buses 12, 14 and 16 as needs dictate. If desired, other peripheral devices such as a printer, could be coupled through appropriate interfaces to the proper ones of the buses 12, 14, and 16.

Timing and control circuit 36 generates control pulses at the required intervals and thus, by way of example, might include a crystal controlled clock and a number of dividing circuits. In the static display of characters on the video display device 34, when no scrolling is taking place, DMA controller 26 and timing and control circuit 36 control the application of signals to the various circuits to cause the desired display. Thus, at the beginning of each character row of the display, DMA controller 26 causes the coded characters stored within memory 28 for that character row to be transferred into line buffer 30. Simultaneously, these characters are applied from line buffer 30 to video signal generator 32 which also receives from line counter 42 the number of the first scan line to be generated for that character row during that frame. If the character is to be displayed in a dot matrix, for example being formed of ten scan lines, numbered scan lines 0 through 10, with 8 dot positions in each character space of each scan line, then timing and control circuit 36 applies pulses to video signal generator 32 at the dot rate. In response to the character codes from line buffer 30, the scan line number from line counter 42, and the dot pulses from timing and control circuit 36, video signal generator 32 generates the dot pattern of the indicated scan line and applies that dot pattern to video display device 34 where it is displayed. Video signal generator 32 receives the same characters from line buffer 30 and receives scan line numbers in sequence from line counter 42 until the last scan line of that character row has been displayed. Then timing and control circuit 36 indicates to CPU 24 that the character row has been completed, and the CPU permits DMA controller 26 to have access to address bus 14 for the purpose of enabling the appropriate memory segments within video display memory 28, causing memory 28 to apply the next row of characters to line buffer 30 for display, and the process is repeated through the complete frame of characters. Timing and control circuit 36 generates the vertical synchronization or vertical sync signal which is applied to the several components to maintain the system in synchronization, including causing vertical retrace of video display device 34.

Figure 2:
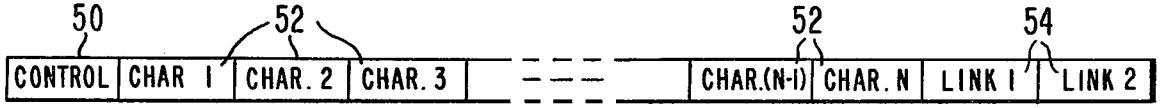
FIG. 2 is a diagrammatic representation of one data word as stored within the display memory of the terminal of FIG. 1.

FIG. 2 diagrammatically depicts each data word as stored within video display memory 28 and transferred to line buffer 30. The data word commences with a control byte 50 which is followed by a number of character bytes 52 equal in number to the number of characters which can be displayed in each character row on video display device 34. Following the last character byte are two linking bytes 54. Each byte in the data word might include 8 bits. Thus, the characters stored within the character bytes 52 might be encoded in ASCII code or any other suitable code. Control byte 50 might include 4 bits indicating presence or absence of attributes of the character row to be displayed. These attributes might include, for example, making each character in a double high or a double wide display, reversing the display so that rather than forming light characters on a dark background, the characters are displayed in dark characters on a light background, blinking of characters, display of the characters at half intensity, or any other desired attributes. Control byte 50 also includes a 4 bit line count signal indicative of the number of first scan line of that character row which is to be generated and displayed during that frame. If scrolling is not occurring, and provided none of the enabled attributes, such as a double high character, requires otherwise, then this line count signal would be a representation of the number zero to indicate that the character row is to commence at its first scan line.

Each link byte 54 likewise has 8 bits. The 8 bits of the first link byte and the first 4 bits of the second link byte indicate the address within video display memory 28 at which is stored the first byte of the data word representing the next character row to be displayed on video display device 34. Since all the bytes of that data word are stored in contiguous memory locations, that address is the address of the data word. If scrolling is not taking place, this is the address of the control byte of the data word representing the adjacent character row of the fixed display. Since this address can be any address within video display memory 28, it is not required that the adjacent character rows be stored in contiguous locations within video display memory 28. The remaining 4 bits of the second link byte indicate the number of scan lines of the current row of characters which are to be displayed during the current frame. If no scrolling is taking place, this number is always ten. Control byte 50 and linking bytes 54 thus control parameters of the operation of video display terminal 10 and can be considered parameter bytes.

When scrolling is to take place, the first scan line to be displayed for the character row which is being scrolled off the display is not scan line zero but instead is a later scan line, and so control byte 50 indicates the scan line number of that later scan line. Similarly, in that character row fewer than all the scan lines are to be displayed in that frame, and so the second link byte 54 indicates the proper number of scan lines for that character row. Likewise, for the new row of characters being scrolled onto the display the second link byte indicates a number, less than ten, which is equal to the number of scan lines to be displayed for that character row during that frame. The display of this new row commences with scan line zero, and so its control byte presets line counter 42 to zero.

Figure 3:
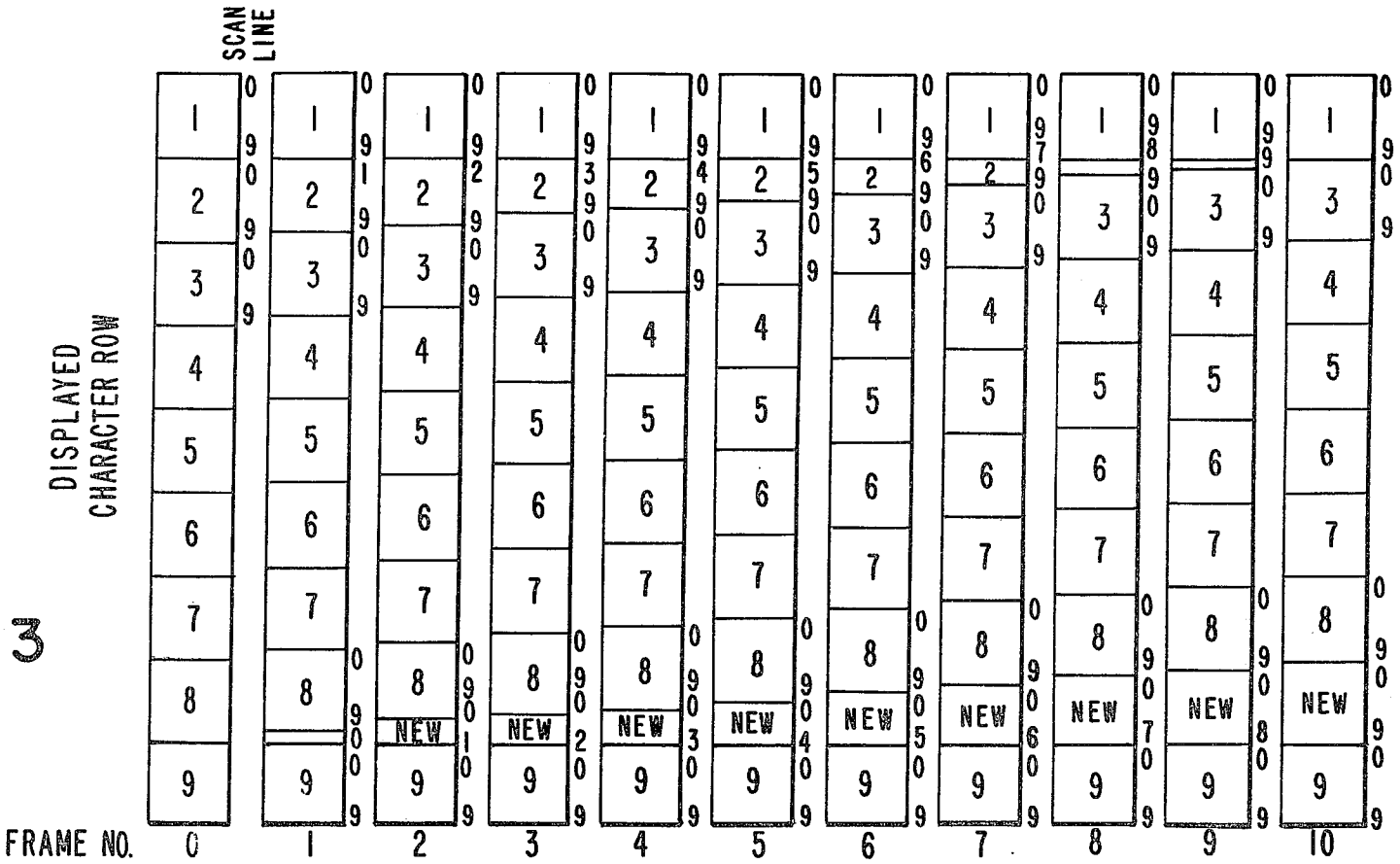
FIG. 3 is a diagrammatic representation of scrolling of the display in accordance with the present invention and is useful in explaining the operation of the invention.

If the display is scrolled at a rate of one scan line per frame, then, with ten scan lines per character row, ten frames of the display are required to scroll a character row completely off the display and to scroll a new character row completely onto the display. FIG. 3 diagrammatically illustrates the display during each of the ten frames. A typical terminal might be capable of displaying, for example, twenty character rows at one time. FIG. 3 depicts nine of those character rows, designated in frame number 0 of FIG. 3 as character rows 1 through 9, and illustrates scrolling of rows 2 through 8, with row 2 being removed from the display and a new character row being inserted between rows 8 and 9. Any number of character rows might be scrolled at one time, and the scrolled rows might be any of the twenty or so character rows of the display. Indeed, in accordance with the present invention, the display screen might be split into several sections with more than one section being scrolled; it is not necessary that all scrolling character rows be contiguous.

Frame number zero in FIG. 3 depicts nine character rows in the frame just before commencement of scrolling of character row number 2 off the display and scrolling of a new row onto the display between original character rows 8 and 9. In frame number zero each of the character rows one through nine includes its full ten scan lines, numbered scan lines 0–9, and the new character row does not appear at all. Accordingly, the control byte of the data word for character row number 2 indicates that scan line number 0 is the first scan line of that character row that is to be displayed during that frame, and the second link byte for character row 2 indicates that 10 scan lines of that character row are to be displayed. During the first frame of the scrolling, indicated in FIG. 3 as frame number 1, the control byte of the data word for character row number 2 indicates that scan line 1 is the first scan line to be displayed during that character row and the second link byte of character row 2 indicates that nine scan lines of that row are to be displayed. Similarly, during frame number 1 the second link byte of the data word for character row 8 contains the memory address of the data word for the new character row being scrolled onto the display and the control byte for that new row indicates that scan line zero of that row is the first scan line of that row to be displayed during that frame, while the second link byte of that new data word indicates that only one scan line of that new character row is to be displayed during that frame. Thus, as illustrated in FIG. 3, in the first frame of the scrolling the second character row is only 9 scan lines long, commencing with scan line 1 rather than scan line zero, and in the new character row only scan line zero is displayed. During the second frame of the scrolling, the control byte for character row 2 indicates that scan line 2 is the first scan line to be displayed for that character row, and the second link byte for that row indicates that eight scan lines of the row are to be displayed. The control byte for the new character row still indicates that its display is to commence with scan line zero, while the second link byte for the new character row indicates that two scan lines of that row are to be displayed. This sequence continues through each frame of the scroll sequence until the tenth frame when character row 2 is totally removed from the display and the new character row is entirely on the display. Just before that tenth frame, then, the second link byte of character row 1 is updated to remove the memory address of the data word for character row 2 and to substitute the memory address of the data word for character row 3, thereby linking character row 1 to character row 3, and the second link byte of the new character row indicates that all ten scan lines are to be displayed. This updating is done by CPU 24 during the vertical retrace interval just prior to the tenth frame of the scroll.

As the data word of FIG. 2 is read from line buffer 30, the bits of the control byte which designate the attributes of the display of that character row are applied to attribute latch 40, which in turn applies them to video signal generator 32. Timing and control circuit 36 applies a signal to attribute latch 40 to cause loading of these control bits into the attribute latch at the proper time. Similarly, the bits of the control byte which indicate the line number of the first scan line to be displayed for that character row are loaded into line counter 42, again under control of a load command from timing and control circuit 36. The character bytes within that data word are then applied to video signal generator 32 and are displayed. The first link byte and the first 4 bits of the second link byte are applied from line buffer 30 to DMA controller 16 to indicate to the controller the address within video display memory 28 at which the first or control byte of the data word for the next character row is stored. Timing and control circuit 36 provides a load signal to DMA controller 26 for that purpose. DMA controller 26 can include a counter which is preset by the address signal within link bytes 54 and which is incremented by a character pulse signal from timing and control circuit 36 following each character interval of the first scan line of each character row. During this first scan line DMA controller 26 has access over address bus 14 to video display memory 28 to enable the associated memory locations. The remaining bits of the second link byte are applied to scan counter 38, again under control of a load command from circuit 36, to indicate to the scan counter the number of scan lines of the current character row which are to be displayed.

When no scrolling is taking place, DMA controller 26 only requires access to address bus 14 at the end of each character row; there is no necessity to interrupt CPU 24 for the purpose of updating the parameters of the display, since the control bytes 50 and the link bytes 54 always indicate that all ten scan lines are to be displayed in every character row and provide the memory addresses of the data words for every character row. When scrolling is taking place, it is necessary to interrupt operation of CPU 24 only at the end of each frame so that the display parameters in the control bytes and the linking bytes of the data words involved in the scroll can be updated, as necessary.

Figure 4:
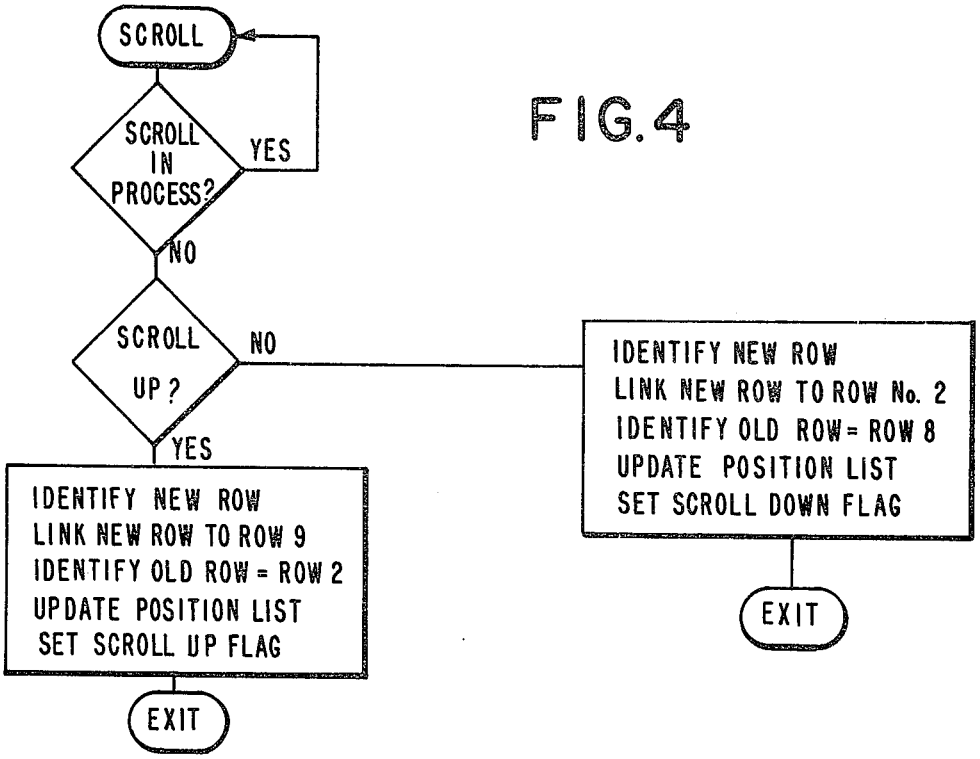
FIGS. 4 and 5 are flow diagrams illustrating operation of the scrolling technique of the present invention.

FIG. 4 is a flow diagram of the sequences within the terminal when it is indicated that a scroll is to commence. This indication might come from the keyboard or from the host computer. If a scroll of more than one character row's duration is occurring, a new scroll command occurs for each character row. When a scroll command is received, then, CPU 24 determines whether a scroll is already in process, as might be the case in the middle of a sequence when several character rows are being scrolled off the display and several new character rows are being scrolled on. If a scroll is in process CPU 24 waits for the completion of that scroll. When no scroll is occurring and the scroll command is present, CPU 24 determines whether a scroll up is commanded. If so, the CPU initializes the scroll up function. The new row to be scrolled onto the display is identified and then linked to the row which is to follow it on the display, indicated in FIG. 4 as row 9 in keeping with the example of FIG. 3. The old row, to be scrolled off the display, is also identified, shown in FIG. 4 as row 2. CPU 24 then updates its position list to indicate which character rows will be on the display once that scroll is completed. Then CPU sets a scroll up flag, which is a signal to indicate that during the next vertical retrace interval there should be a CPU interrupt to permit updating of the scroll parameters, as set out in the control bytes and link bytes of the affected data words within video display memory 28.

As indicated in FIG. 4, if CPU 24 determines that a scroll down is commanded, it initializes the scroll down function in an analogous manner.

Figure 5:
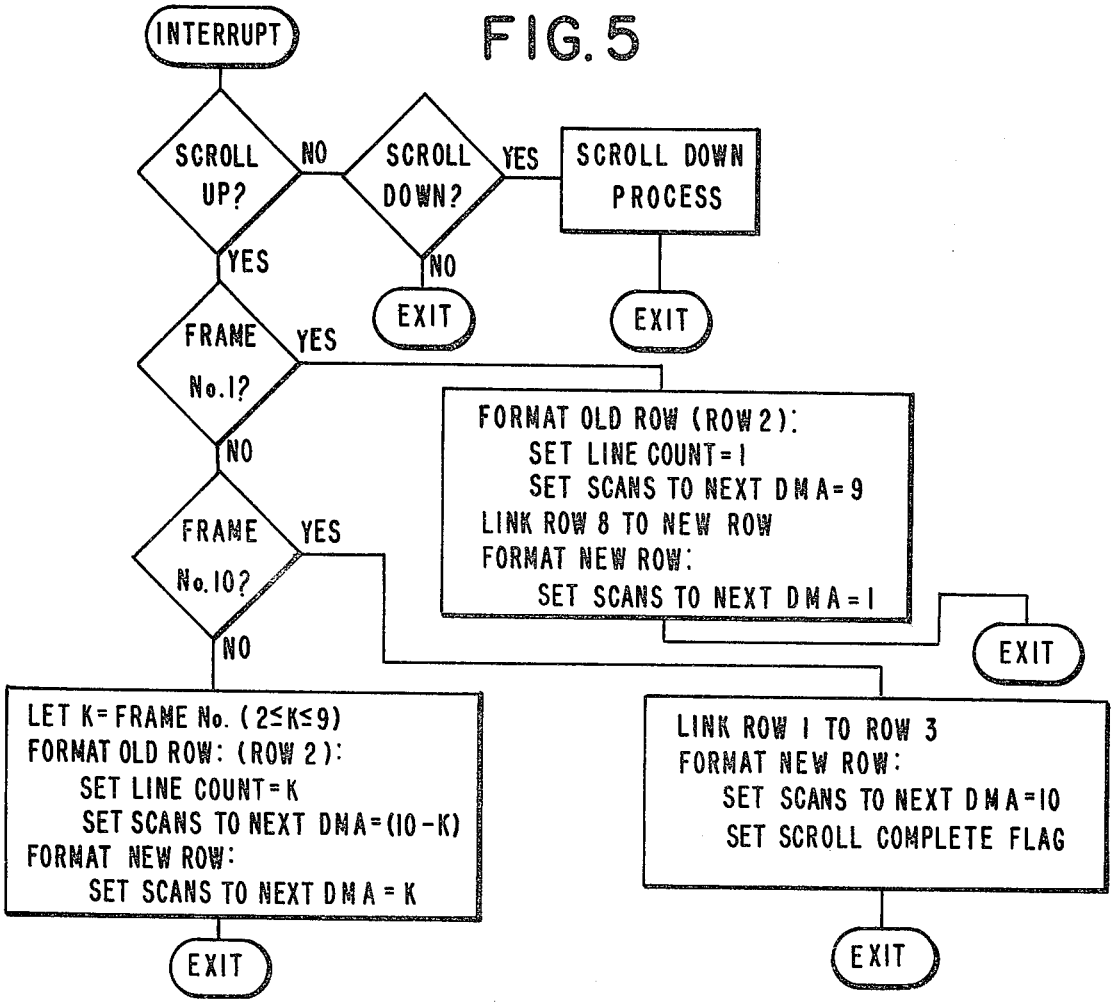

FIG. 5 is a flow diagram of the scroll process, depicting sequences occurring during the CPU interrupt of the vertical retrace interval. First, it is determined whether a scroll up is to take place. If not, then it is determined whether a scroll down is to take place. If not, then the sequence ends. If a scroll up is taking place, the frame number of the scroll is determined from a counter which is activated by the scroll up initialization process of FIG. 4 and which is incremented during each vertical retrace interval. If it is frame number 1, then the following sequences take place: The old row which is being scrolled off the display is formatted. In the example of FIG. 3, this is character row number 2, and it is formatted by setting its line count (i.e., the number of the first scan line to be displayed) to one and setting the scan count (i.e., the number of scan lines to be displayed during that character row, before the next DMA sequence) to 9 so that the display of this character row commences with the second scan line and continues through the tenth scan line. The new row is to be scrolled onto the display after character row 8, and so row 8 is linked to the new row. As set forth above, during the scroll up initialization process of FIG. 4, the new row was linked to row 9. The new row is formatted by setting its scan count to one. Then the CPU sequence ends.

If it is determined that this is not the first frame of the scroll, then it is determined whether it is the tenth or last frame of the scroll. If it is not, then the old row is formatted by setting its line count to the frame number within the scroll sequence, so that that scan line is the first scan line to be displayed during that frame, and by setting its scan count to ten minus the frame number. The new row is likewise formatted by setting its scan count to the frame number. Then that sequence ends.

If it is determined that it is the tenth, and thus last, frame of the scroll, then row one is linked to row 3, so that row 2 is totally removed from the display, and the new row is formatted by setting its scan count to 10. A scroll complete flag or signal is then activated to indicate to the system that the scrolling process has ended. This completes the scrolling sequence.

If it has been determined that a scroll down is to take place, then the scroll down process is followed. This scroll down process is analogous to the above-described scroll up process but the new row is inserted near the top of the display, for example between character rows 1 and 2, while a lower row, for example character row 8, is removed by scrolling it off the display, commencing with its tenth or last scan line.

During the vertical retrace interval a fixed memory address, for example an address of 000, is applied to DMA controller 16, and so each frame of the display commences with the data word having that memory address. This data word is encoded to produce a blank character row which masks the beam during the latter portion of vertical retrace, so that the vertical retrace interval needs to blank the beam during only the first portion of the vertical retrace, and which provides a variable top margin for the display. The scan count of this fixed data word can be adjusted to permit adjustment of the point on the raster at which the character display commences, thereby accommodating the characteristics of each individual video display device. The link bytes of this first data word, then, include the memory address of the first row of characters to be displayed.

The characters to be displayed are stored in video display memory 24 in memory segments, with each memory segment storing one character row. There must be at least as many memory segments as there are character rows on video display device 34. Preferably, memory 24 has sufficient memory segments to store all the text to be scrolled, rather than reloading the memory segment of the character row just scrolled off the display with the next memory segment to be scrolled onto the display, since such reloading requires memory access time. Thus, the present invention reduces the amount of time CPU 24 is interrupted while permitting substantially continuous scrolling of the display with simplified hardware.

Although the present invention has been described with reference to a preferred embodiment, modifications and rearrangements can be made, and still the result would be within the scope of the invention.

What is claimed is:

1. Apparatus for generating a video display of a plurality of characters in a plurality of video frames, each frame including a plurality of character rows, each displayed character row being formed of a plurality of scan lines and having a plurality of character spaces, with a vertical retrace interval occurring following generation of each video frame and prior to generation of the next video frame, the plurality of characters to be displayed being selected from a group of characters including a plurality of character rows at least equal in number to the plurality of character rows to be displayed in one of the video frames, and permitting substantially continuous scrolling of the displayed character rows with the scrolling off of a character row including the removal of one scan line thereof during each of a plurality of video frames until the character row is completely removed and the scrolling on of a character row including the addition of one scan line thereof during each of a plurality of video frames until the character row is completed, said apparatus comprising:

a video display memory having a plurality of memory segments each with a memory address, each memory segment including a plurality of contiguous character storage locations, equal in number to the number of character spaces in one of the character rows, for storing coded representations of characters to be displayed on a video display device, and at least one parameter storage location for storing a coded parameter signal indicative of desired parameters for the display of the associated character row;

a controller responsive to receipt of a memory address signal indicative of a memory segment within said video display memory for enabling the indicated memory segment;

video display generating means coupled to said video display memory for generating a video display of the characters represented by the coded representations stored in the enabled memory segment;

means responsive to a first property of the coded parameter signal stored in the enabled memory segment for causing said video display generating means to commence the generation of the video display at a preselected one of the scan lines of the characters represented by the coded representations stored in the enabled memory segment and responsive to a second property of the last-named coded parameter signal to end the generation of the video display after generation of a preselected number of scan lines thereof;

means for applying to said controller a memory address signal encoded within the coded parameter signal stored in the enabled memory segment, to cause said controller to next enable the memory segment indicated by the last-named memory address signal; and means for updating the coded parameter signals during vertical retrace intervals to format the first properties, the second properties and the stored memory address signals within selected ones of the coded parameter signals to change the preselected ones of the scan lines, the preselected numbers, and the indicated memory segments thereof to cause scrolling of the display.

2. Apparatus as claimed in claim 1 in which each of said memory segments includes a first parameter storage location adjacent one end of said plurality of contiguous character storage locations and a second parameter storage location adjacent the other end of said plurality of contiguous character storage locations.

3. Apparatus as claimed in claim 2 in which each first parameter storage location stores the first property for the associated character row and each second parameter storage location stores the second property for the associated character row and the memory address for the next character row to be displayed.

4. Apparatus as claimed in claim 1 in which said controller comprises a counter, means for presetting said counter with memory address signals applied thereto, means for incrementing said counter after generation of each character portion of the first scan line of each character row, and means for coupling said counter to said video display memory.

5. Apparatus as claimed in claim 1 in which said means responsive to the first property and the second property of the coded parameter signal includes a counter and means for presetting said counter in response to one of the first and second properties.

6. Apparatus as claimed in claim 1 in which said means responsive to the first property and the second property of the coded parameter signal comprises a first counter, means responsive to the first property for presetting said first counter to a count signal indicative of the first scan line to be displayed in the associated character row, means for incrementing said first counter at the end of each scan line, means for applying the count signal from said first counter to said video signal generator, a second counter means responsive to the second property for presetting said second counter to a number indicative of the number of scan lines on the associated character row to be displayed, means for incrementing said second counter at the end of each scan line, and means responsive to said second counter being incremented to the preset number for indicating completion of generation of the associated character row.

7. A method of generating a video display of a plurality of characters on a video display device in a plurality of video frames, each frame including a plurality of character rows, each displayed character row being formed of a plurality of scan lines and having a plurality of character spaces, with a vertical retrace interval occurring following generation of each video frame and prior to generation of the next video frame, the plurality of characters to be displayed being selected from a group of characters including a plurality of character rows at least equal in number to the plurality of character rows to be displayed in one of the video frames, including substantially continuous scrolling of the displayed character rows, with the scrolling off of a character row including the removal of one scan line thereof during each of a plurality of video frames until the character row is completely removed and the scrolling on of a character row including the addition of one scan line thereof during each of a plurality of video frames until the character row is completed, said method comprising:

(a) storing in a memory coded representations of characters to be displayed on a video display device, with the coded representations of characters forming each character row stored as a segment in contiguous locations;

(b) storing in said memory in association with each segment of stored character representations a coded parameter signal indicative of desired parameters for the display of the associated character row, with each thus-stored segment of character representations and associated coded parameter signal being stored in a memory segment having a memory address;

(c) generating a video signal of a character row of the character representated by the coded representations of characters stored in a selected one of said memory segments, including commencing the generation at a scan line indicated by a first property of the associated parameter signal and ending the generation following generation of a number of scan lines indicated by a second property of said associated parameter signal;

(d) generating a video signal of a character row of the characters represented by the coded representations of characters stored in one of said memory segment, indicated by a memory address signal within the parameter signal associated with the most recent previously generated character row video signal, including commencing the generation at a scan line indicated by a first property of the parameter signal associated with the character row video signal then being generated and ending the generation following generation of a number of scan lines indicated by a second property of the last-named parameter signal;

(e) repeating step (d) to generate a video display frame;

(f) updating the coded parameter signals during the vertical retrace interval to format the first properties, the second properties, and the memory address signals within selected ones of the coded parameter signals to change the scan line indications of the first properties, the number of scan lines indicated by the second properties, and the memory address signals, to cause scrolling of the display; and (g) repeating steps (c) through (f) to provide a scrolled display.

8. A method as claimed in claim 7 in which each first property is stored in a first parameter storage location adjacent one end of the contiguous locations storing the coded representation segment for the associated character row, each second property is stored in a second parameter storage location adjacent the other end of the contiguous locations storing the coded representation segment for said associated character row, and each memory address signal is stored in an address storage location adjacent the other end of the contiguous locations storing the coded representation segment for the character row to be displayed just prior to said associated character row.

* * * * *